US008341903B2

(12) United States Patent
Haab et al.

(10) Patent No.: US 8,341,903 B2
(45) Date of Patent: Jan. 1, 2013

(54) CONNECTING DEVICE FOR A SEPARATION ELEMENT AND SEPARATION ELEMENT

(75) Inventors: Gregor Haab, Allenwinden (CH); Stefan Hagger, Boppelsen (CH)

(73) Assignee: Hawa AG, Mettmenstetten (CH)

( * ) Notice: Subject to any disclaimer, the term of this patent is extended or adjusted under 35 U.S.C. 154(b) by 72 days.

(21) Appl. No.: 12/662,762

(22) Filed: May 3, 2010

(65) Prior Publication Data

US 2010/0281812 A1 Nov. 11, 2010

(30) Foreign Application Priority Data

May 11, 2009 (EP) ..... 09159952

(51) Int. Cl.
*E04B 2/58* (2006.01)
*E04B 2/78* (2006.01)

(52) U.S. Cl. ..... 52/238.1; 52/271; 52/282.3; 52/275; 52/474

(58) Field of Classification Search ..... 52/238.1, 52/239, 243.1, 204.71, 281, 474, 271, 204.7, 52/745.21, 270, 282.3, 275, 96, 208, 204.595, 52/204.72
See application file for complete search history.

(56) References Cited

U.S. PATENT DOCUMENTS

| | | | | | |
|---|---|---|---|---|---|
| 2,525,717 | A | * | 10/1950 | Ottenheimer | 52/172 |
| 2,589,517 | A | * | 3/1952 | Stelzer | 52/204.593 |
| 2,840,869 | A | * | 7/1958 | Fegan | 52/208 |
| 2,939,186 | A | * | 6/1960 | Norwood et al. | 52/200 |
| 2,983,001 | A | * | 5/1961 | Guldager | 52/208 |
| 3,512,320 | A | * | 5/1970 | Roch et al. | 52/172 |
| 3,667,179 | A | * | 6/1972 | Eisenberg | 52/209 |
| 3,940,900 | A | * | 3/1976 | Russo | 52/656.1 |
| 4,067,548 | A | * | 1/1978 | Murphy | 256/24 |
| 4,535,577 | A | * | 8/1985 | Tenser et al. | 174/495 |
| 4,574,547 | A | * | 3/1986 | Menchetti et al. | 52/238.1 |
| 4,703,598 | A | * | 11/1987 | Wilson et al. | 52/238.1 |
| 4,879,854 | A | * | 11/1989 | Handler | 52/238.1 |
| 4,914,883 | A | * | 4/1990 | Wencley | 52/309.5 |

(Continued)

FOREIGN PATENT DOCUMENTS

| | | | |
|---|---|---|---|
| DE | 35 09 187 | A1 | 9/1986 |
| FR | 2 734 019 | A1 | 11/1996 |
| GB | 1 539 504 | | 1/1979 |
| GB | 2029482 | A * | 3/1980 |

OTHER PUBLICATIONS

Sep. 23, 2009 Search Report issued in European Patent Application No. 09 15 9952.2 (with translation).

*Primary Examiner* — Phi Dieu Tran A
(74) *Attorney, Agent, or Firm* — Oliff & Berridge, PLC

(57) ABSTRACT

A separation element including a panel and a connecting device for use with an adhesive. The connecting device includes at least one profile strip and a separation profile. The profile strip includes a back element, a first side element and a second side element that together define a mounting channel, and an anchor channel defined by the profile strip. The anchor channel is connected to the mounting channel by a through slot. The mounting channel is configured such that the edge of the panel is held within the mounting channel by means of the adhesive. The separation profile separates the profile strip from the panel, and it includes a middle part, a first side part, and a second side part and defines at least one window opening that functions to allow the adhesive to penetrate into the anchor channel.

18 Claims, 8 Drawing Sheets

Figure 1:
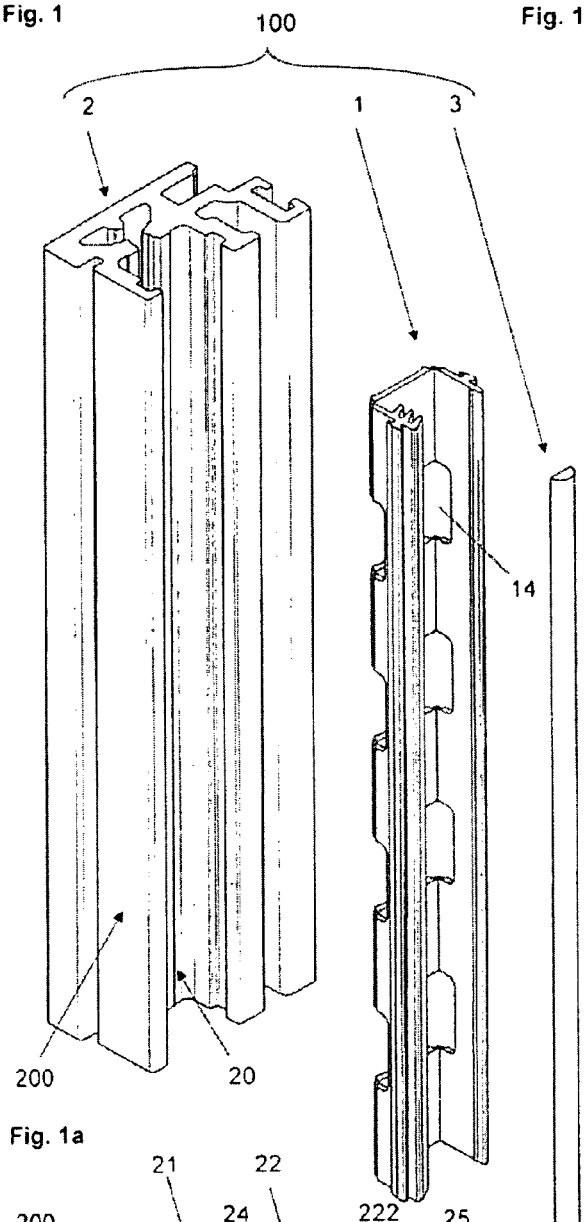

U.S. PATENT DOCUMENTS 4,920,717 A * 5/1990 Hooper, Jr. ..... 52/204.597
5,069,010 A * 12/1991 Trainor et al. ..... 52/127.8
5,125,201 A * 6/1992 Pieters et al. ..... 52/238.1
6,052,867 A 4/2000 Haab et al.
6,418,588 B1 7/2002 Haab et al.
6,419,209 B1 * 7/2002 Shepherd ..... 256/24
6,434,905 B1 * 8/2002 Sprague ..... 52/474
6,675,541 B2 * 1/2004 Mackey ..... 52/208
7,036,799 B2 * 5/2006 Shepherd ..... 256/73
7,730,677 B2 * 6/2010 Hansen ..... 52/204.5

* cited by examiner

Fig. 2
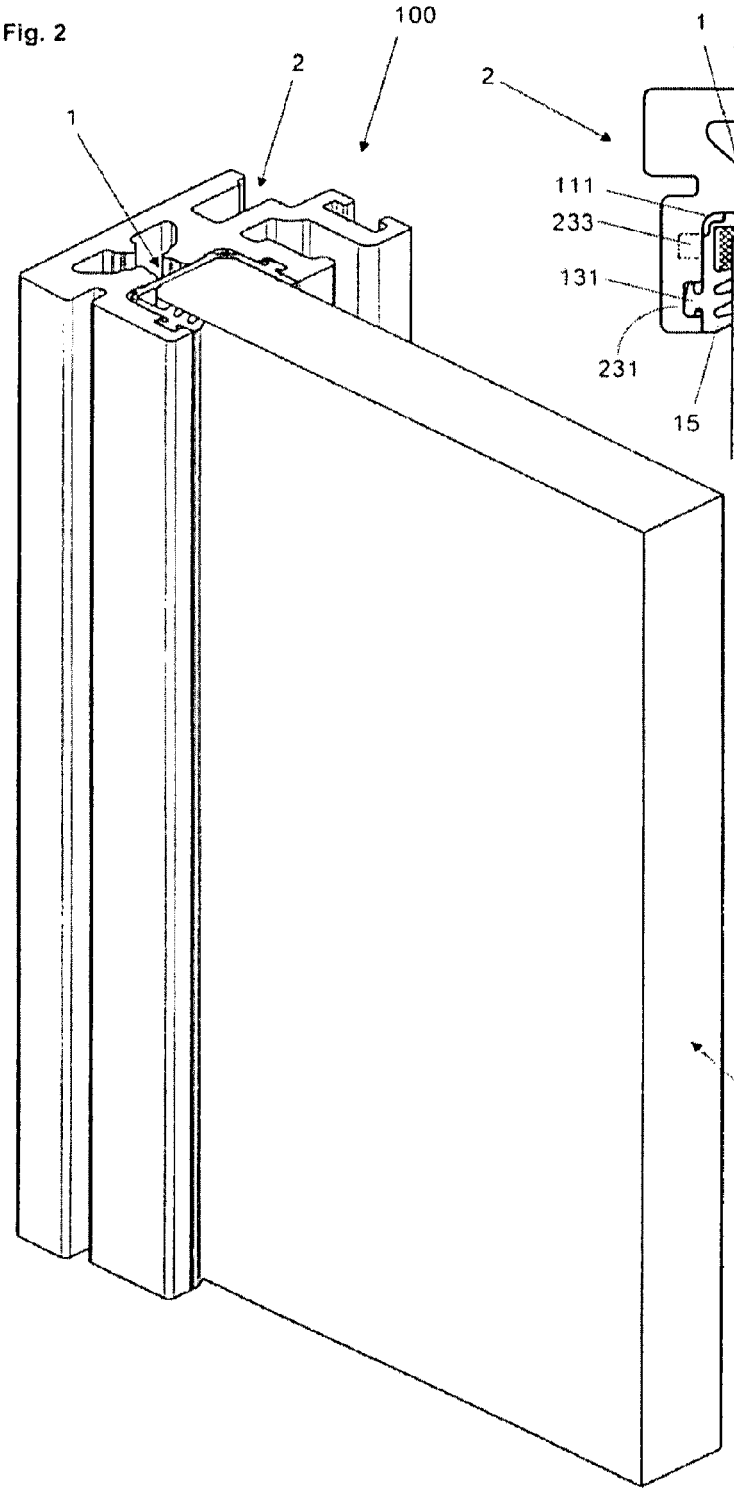
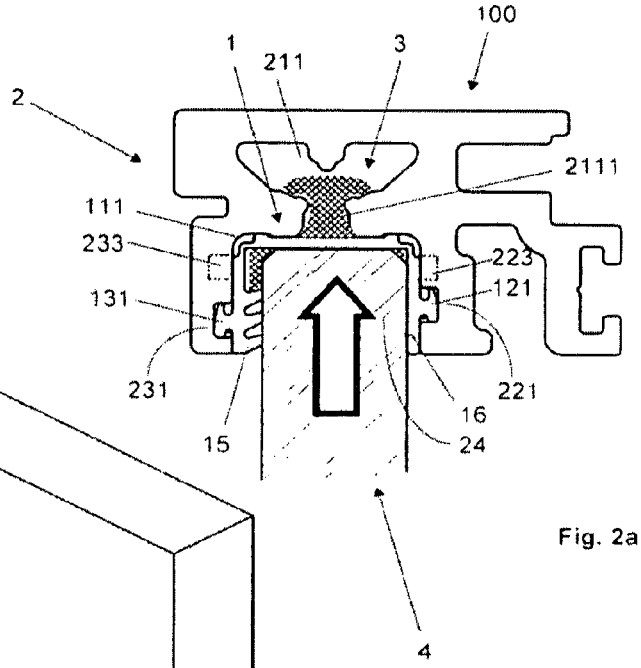
Fig. 2a

Fig. 7
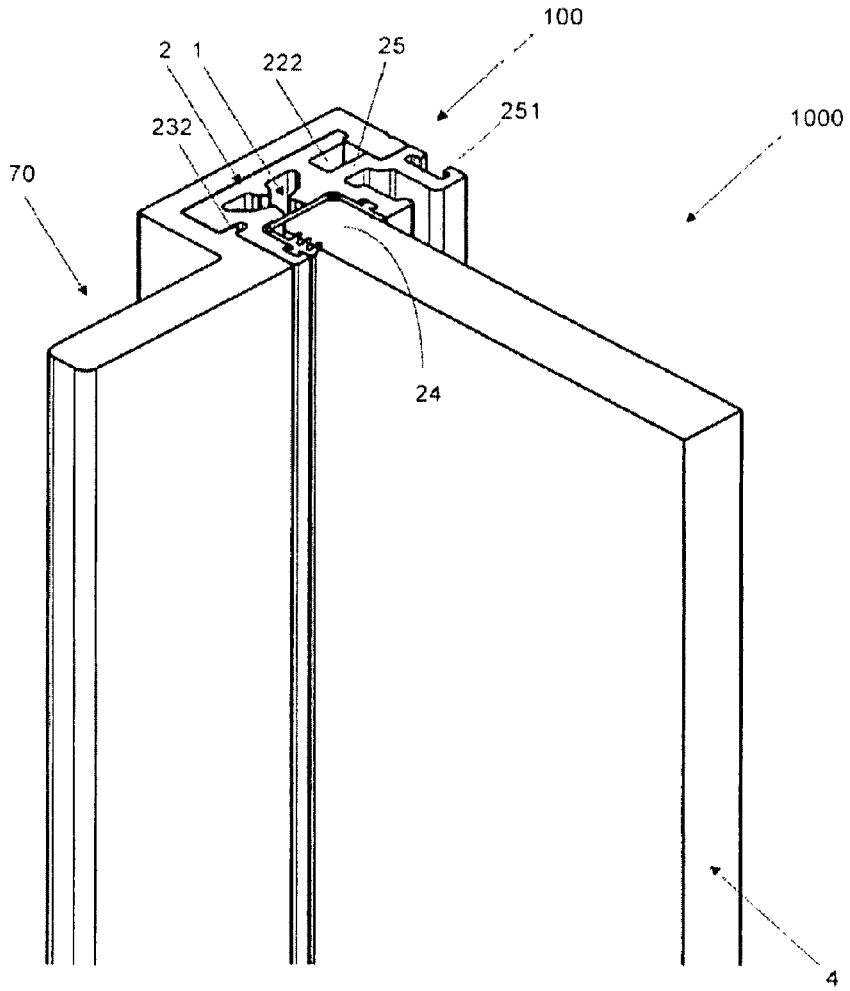
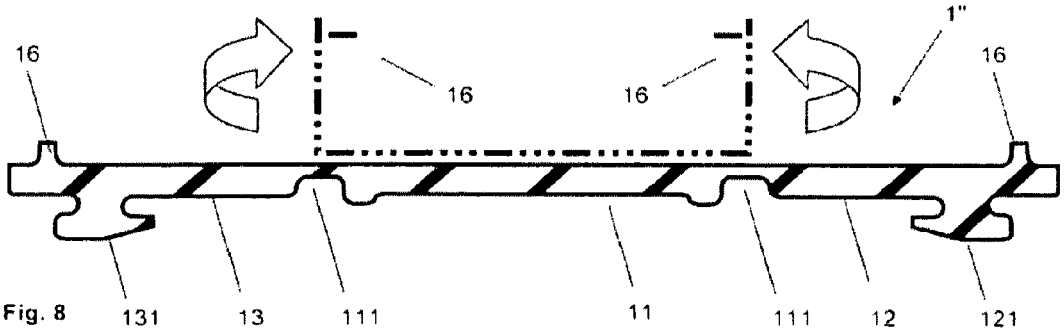
Fig. 8

CONNECTING DEVICE FOR A SEPARATION ELEMENT AND SEPARATION ELEMENT

The invention relates to a connecting device for a panel-form separation element, in particular a glass panel, and to a separation element provided with the connecting device.

In order to separate or form areas or to close off room or window openings, walls, sliding elements, doors or blinds provided with a panel (hereinafter referred to as separation elements) are often used, which are fixedly mounted or fixed to carriages displaceable along a rail and optionally pivotally mounted.

For the purpose of assembly, handling, aesthetic design or protection of such separation elements it is often necessary for them to be provided peripherally with profile elements.

With profile strips a frame can be formed for example that supports or carries the glass panel.

It is known from [1], DE 35 09 187 A1, that a wing frame formed by profile strips can form the supporting element of a separation element such as a glass panel. In order to mount profile strips these have been clamped for example to the glass panel and subsequently closed with a sealant. It has thereby been ascertained that composite glass is not suitable for this type of connections, because the edge of such composite glass does not withstand the clamping.

In order to avoid disruptive stresses when connecting profile elements with composite glass, it is proposed in [1] to provide the profile strips with at least one mounting channel, which serves to receive the edge of the glass panel, which edge is fixed within the mounting channel by means of an adhesive.

Disadvantageous with this solution is that various problems can arise when handling the adhesive. On the one hand it is to be ensured that the adhesive is evenly distributed in the mounting channel and in all holding grooves provided therein. When placing the profile strip on the edge of the glass panel it is scarcely possible to avoid the adhesive from escaping and contaminating the free lying surface of the glass panel. Contamination that arises must be removed, which requires correspondingly high efforts. Typically, also irregular edge terminations result from the use of the adhesive, which should be avoided in particular for aesthetic reasons. Furthermore it is not only to be ensured that a bead of adhesive is incorporated with an even cross-section into the mounting channel, but also that the bead of adhesive runs with high precision centrally within the mounting channel. This is scarcely achievable in practice.

Furthermore the profile strip is to be secured after connection to the glass edge until the adhesive has hardened. Furthermore the edge of the glass panel is to be positioned within the mounting channel of the profile strip by auxiliary means in such a way that the glass panel is held in a desired position and cannot come into direct contact with the metal profile element under any circumstances.

Furthermore it is scarcely unavoidable for the profile strips to vary slightly in their positioning from separation element to separation element, in particular assuming different positions in relation to the front face of the glass panel. In addition profile elements can assume an undesirable inclination in relation to the glass panel or extend transversely within the mounting channel. This erroneous positioning is disadvantageous particularly if further profile elements or covering elements are mounted or if adjacent separation elements are provided, of which the profile elements are mounted differently. In such cases the device parts are not arranged in a plane and/or parallel to a straight line, whereby this leaves a disadvantageous aesthetic impression in multi-part glass fronts.

A device for connecting a glass panel to a guide device guided in a rail is further known from [2], U.S. 60/520,867. For this connection, a first and a second fixing part are provided, which fixing parts project into a cut-out in the glass panel and are connected by means of a connecting screw to the guide device. This type of connection of the glass panel to the guide device necessitates processing of the glass panel using a relatively high level of resources. Furthermore said fixing parts project into the glass panel and are perceived as distracting under certain circumstances.

It is thus an object of the present invention to create an improved connecting device for panel-form separation elements, in particular glass panels, which is not encumbered with the disadvantages described.

In particular a connecting device comprising at least one profile strip is to be created, which can be quickly and easily mounted and ensures a constantly precise positioning of the glass panel within the profile strip. In addition it is to be guaranteed that even with different thicknesses of the glass panel the distance from a side of the glass panel to the profile element is constantly the same. Furthermore direct contact between the metal profile strip and the glass panel is to be excluded through the connecting device.

In addition subsequent processing such as cleaning or sealing work is to be avoided when using the connecting device.

Furthermore a fixedly or displaceably mounted separation element is to be created, which is provided with at least one such connecting device.

With the use of the connecting device, it should further be advantageously possible to connect the separation element to further devices or device parts, in particular to a hand grip and/or, on the lower side and/or the upper side, to a guide device, and for the separation element thereby to be displaceably mounted.

This object is achieved with a connecting device and with a separation element having the features indicated in claims 1 and 12. Advantageous embodiments of the invention are indicated in further claims.

The connecting device, which is provided for a separation element with a panel, particularly a glass panel, includes at least one profile strip, which comprises a back element and a first and a second side element, which define a mounting channel, within which the edge of the panel is held by means of an adhesive.

According to the invention the profile strip comprises an anchor channel, which is connected to the mounting channel by a through slot. Within the mounting channel a separation profile is provided, which comprises window openings, through which the incorporated adhesive can penetrate into the anchor channel. Said separation profile separates with a middle part the back element from the panel and with a first side part the first side element of the profile strip from the panel and with a second side part the second side element of the profile strip from the panel.

With the separation profile the profile strip is thus reliably separated from the glass panel. The metal profile strip, preferably an extruded aluminium profile, is prevented from coming into contact with the glass panel and damaging it.

The bead of adhesive, e.g. a silicone adhesive sealant, introduced into the mounting channel or applied on the narrow side edge of the glass panel, can be evenly distributed when the glass panel is introduced into the mounting channel.

Excess adhesive is thereby displaced into the anchor channel and evenly distributed there. At points with excess adhesive the latter is thus pressed into the anchor channel and not outwardly over the glass panel.

After hardening the adhesive within the anchor channel is held there in a shape-locking way, meaning that detachment of the adhesive from the inner profile of the profile strip is prevented even under great loads. For this, it is provided that the anchor channel has a larger diameter than the through slot, so that a T-shaped profile for example is formed.

A good connection between the glass panel and the profile strip can already be achieved with the separation profile. The connection of the separation profile to the inner profile of the profile strip can be carried out in a shape-locking or force-locking way. Preferably, each of the side elements of the profile strip comprises at least one anchor groove open towards the mounting channel. Said anchor groove serves in particular to receive a preferably provided anchor element, which is provided on the side of the separation profile facing the profile strip. Insofar as anchor elements are provided on the separation profile and are introduced into the associated anchor groove in the profile strip, the separation profile is held sufficiently within the mounting channel during the installation even if the adhesive has not yet hardened. By using the inventive separation profile the installation process is therefore considerably simplified.

Additionally or alternatively, anchor grooves can also serve to receive adhesive, which is held in a shape-locking way by the anchor channel and the anchor grooves after hardening. For example a first anchor groove serves to receive an anchor element of the separation profile and a second anchor groove serves to receive adhesive. In preferred embodiments the separation profile comprises additional openings, through which the adhesive can be pressed for example into an anchor groove. In this way it can be ensured that the separation profile is held in a shape-locking way at several points by the hardened adhesive.

The separation profile is preferably produced from elastic or non-elastic plastic using an extrusion process. The separation profile can thereby already be made into a form adapted to the mounting channel provided in the profile strip. The separation profile can thus already have a U-shaped or C-shaped profile after manufacture.

However, the separation profile is preferably formed as an elastic strip that is given its end shape by the user. This occurs when placing the separation profile in the mounting channel in that the side parts of the separation profile are bent towards each other by 90° in relation to the middle part. In order to ensure that this is possible and that it does not lead to any further deformations of the separation profile the two side parts are integrally connected via hinge zones, e.g. film hinges with reduced diameter, to the middle part. The separation profile produced in a strip-form can thus be stored in layers or rolled up on rollers.

In a preferred embodiment at least one of the side parts of the separation profile is provided on the side facing the mounting channel or panel with at least one fin or with at least one sealing rib. A sealing rib is preferably arranged on the first side part and the at least one fin is arranged on the second side part. Alternatively either fins or sealing ribs can be provided on both side parts.

The fins or sealing lips, of which for example three are guided in parallel along the separation profile, thereby serve on the one hand as sealing elements that prevent the escape of the adhesive from the mounting channel. On the other hand the fins push against the glass panel, whereby the latter is thus positioned. Insofar as fins are provided on both side elements the glass panel is centred within the mounting channel. Insofar as, however, only the first side element is provided with fins, the glass panel is pushed against the second side element, on which preferably a sealing rib is provided. The side of the glass panel lying against the sealing rib thus constantly has the same position regardless of the diameter of the glass panel. It is thus ensured, even with different diameters of glass panels, that the device parts lie flush against each other and that there are no projections causing aesthetic or functional interference.

The window openings provided in the separation profile overlap at least partially the middle part or also partially the side parts. It is thereby ensured that a major part of the adhesive is pushed by the glass panel directly against the profile strip and can penetrate there into the anchor channel, possibly also into anchor grooves.

The profile strip comprises an inner profile adapted to the separation profile and preferably an outer profile, which can be connected to an auxiliary profile such as a holding grip or a further frame element, and/or which can be connected to a guide device. For example the connecting device is connected via a coupling device to a carriage guided in a rail. The carriage can thereby slide or roll within the running or guide rail.

The outer profile of the profile strip can be completely included by the auxiliary profile or by the coupling device. Alternatively the outer profile can comprise at least one mounting groove or a holding groove, into which the auxiliary profile or the coupling device can engage in a shape-locking way. Furthermore alternative mounting possibilities can be realised.

Using the inventive connecting device it is thus possible to securely hold glass panels on a relatively narrow edge on the upper side and/or lower side of a glass panel and to connect them with conventional guide devices.

Instead of mounting elements that project relatively far into the glass panel, narrow profile strips are used, which can scarcely be seen. It is particularly advantageous that machining of the glass panel, with the incorporation of bores and recesses, is completely unnecessary. The connecting elements can be designed in any form and connected to the profile strip and locked in any manner.

The inventive profile strips can be used to fully frame the glass panel. It is further possible for profile strips to be provided only on one side or on opposite sides. The mounting of the connecting device on the sides of the glass panel takes place for example in order to protect the glass panel.

The ends of the profile strips are preferably provided with termination parts that comprise an opening for receiving a corner of the glass panel. For the purpose of fixing, the termination parts preferably comprise a screw channel, into which a mounting screw can be introduced. The mounting screw is preferably received by the anchor channel, which comprises a plurality of thread ribs, between which the mounting screw can be turned.

The termination part can preferably be connected to two profile strips. Alternatively the termination part can be connected to only one profile strip and adapted to a cover profile, extending perpendicular to the profile strip, and can possibly hold said cover profile. It is preferably provided that all device parts are adapted so as to be flush with each other so that irregular projections causing visual distraction are avoided.

Figure 1B:
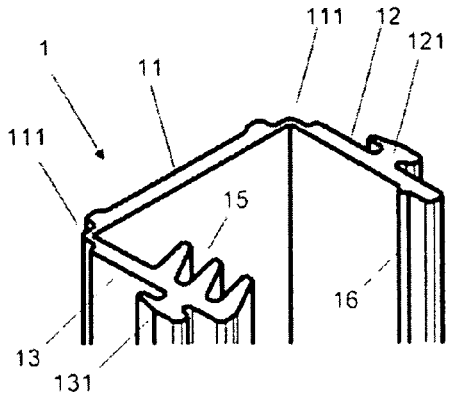
Figure 1B:
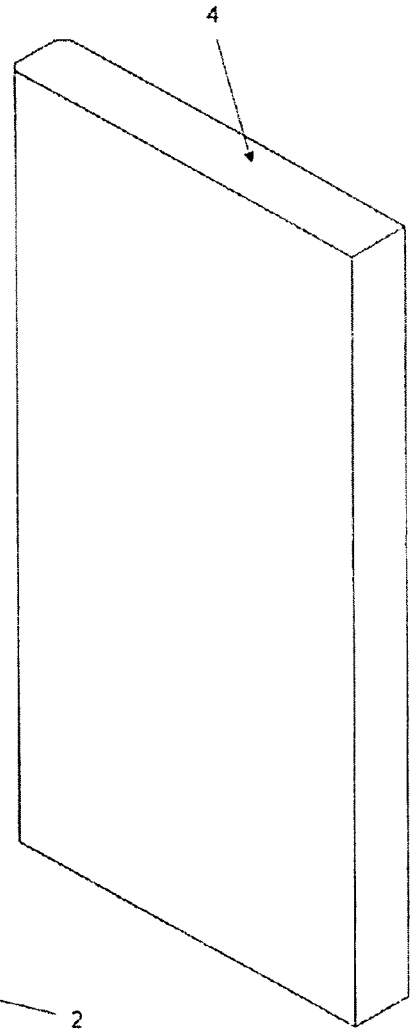
Figure 1A:
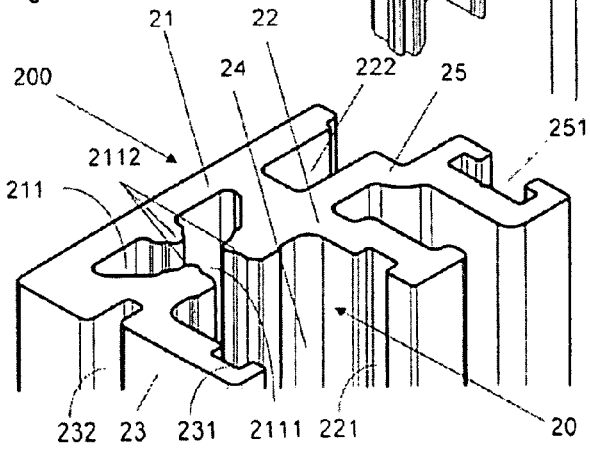
Figure 3A:
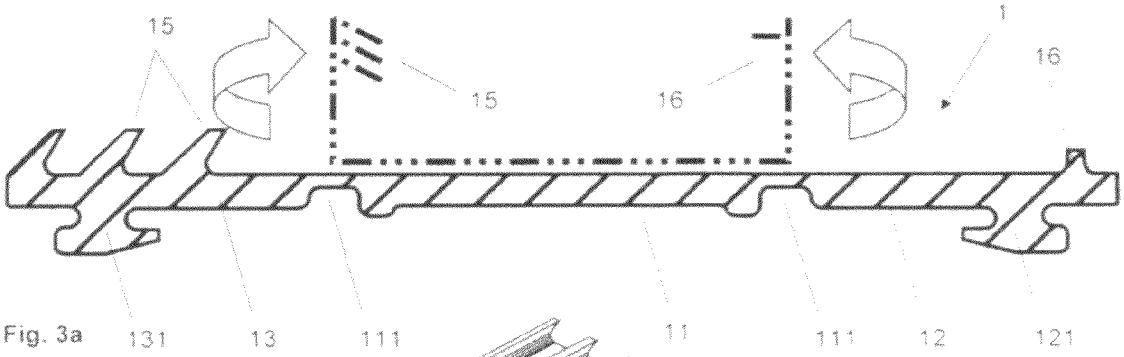
Figure 3B:
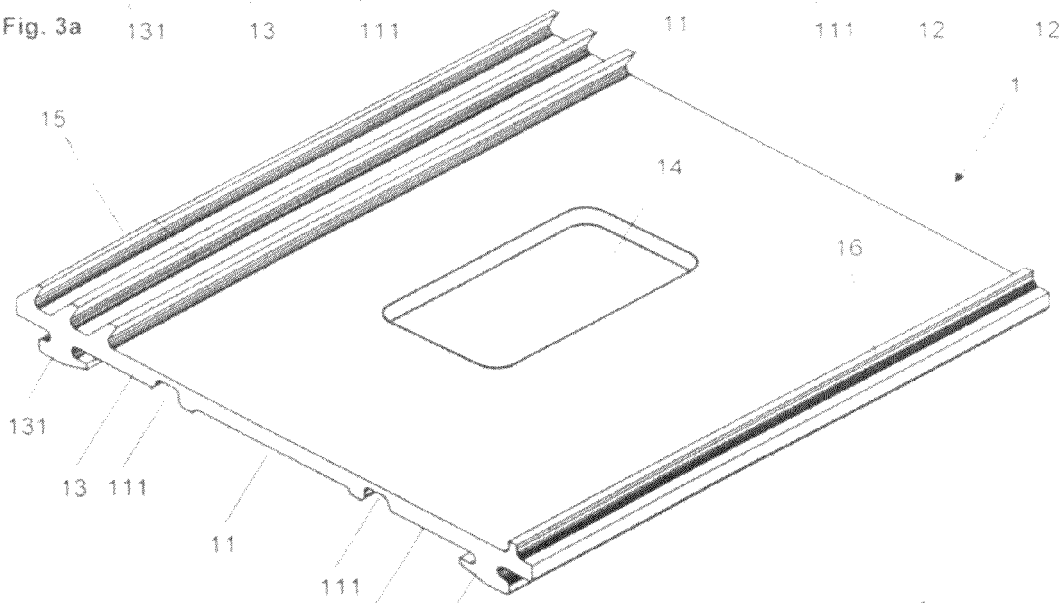
Figure 3C:
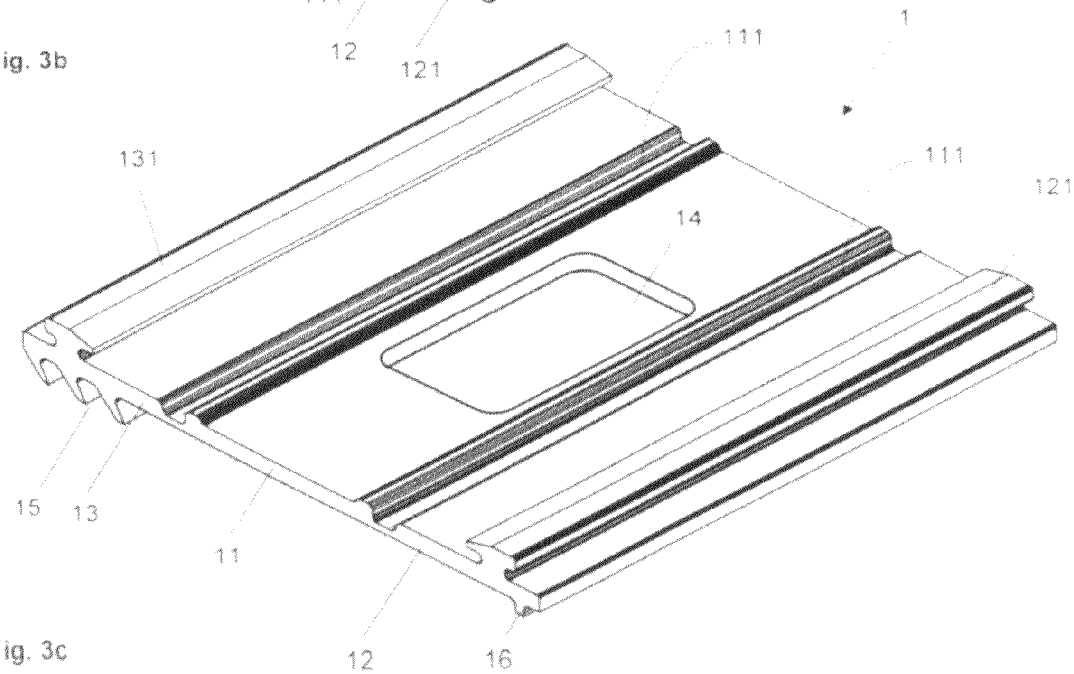
Figure 4A:
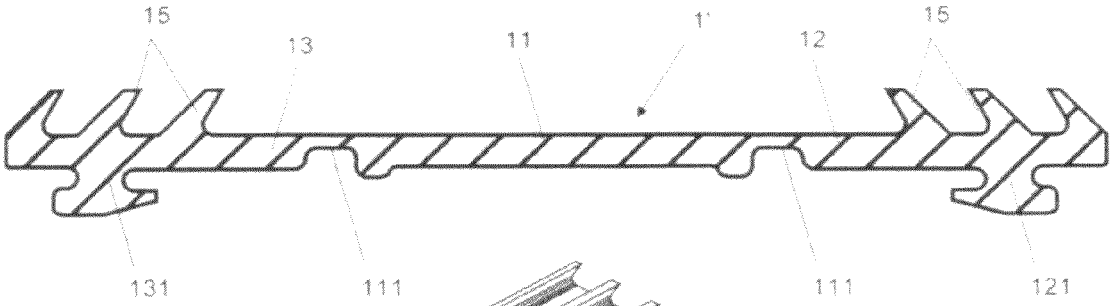
Figure 4B:
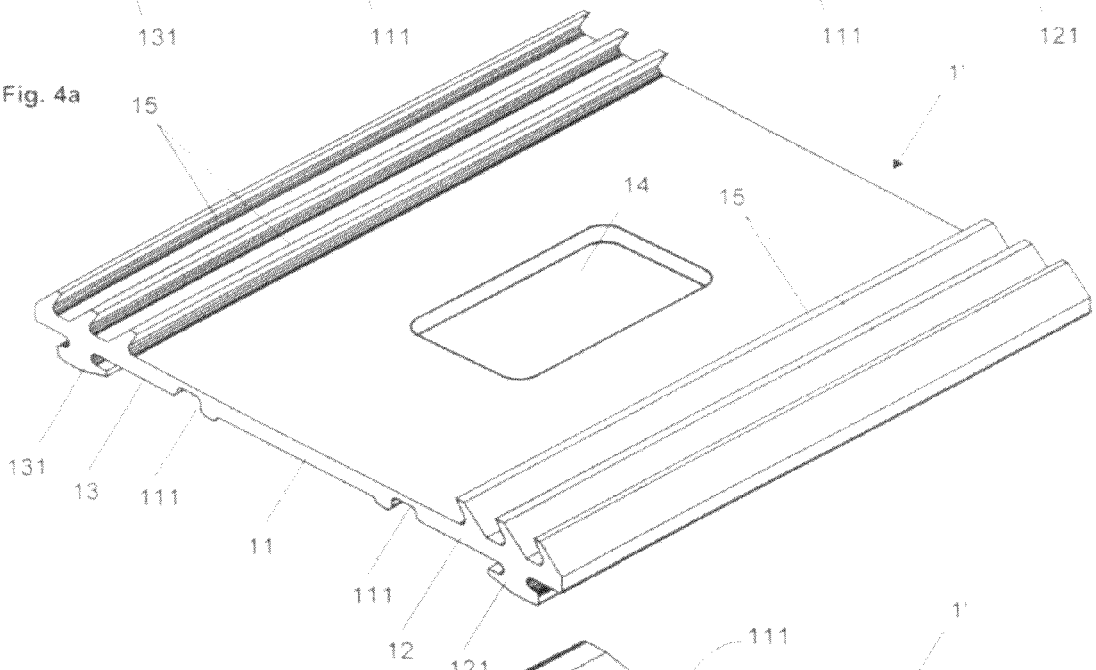
Figure 4C:
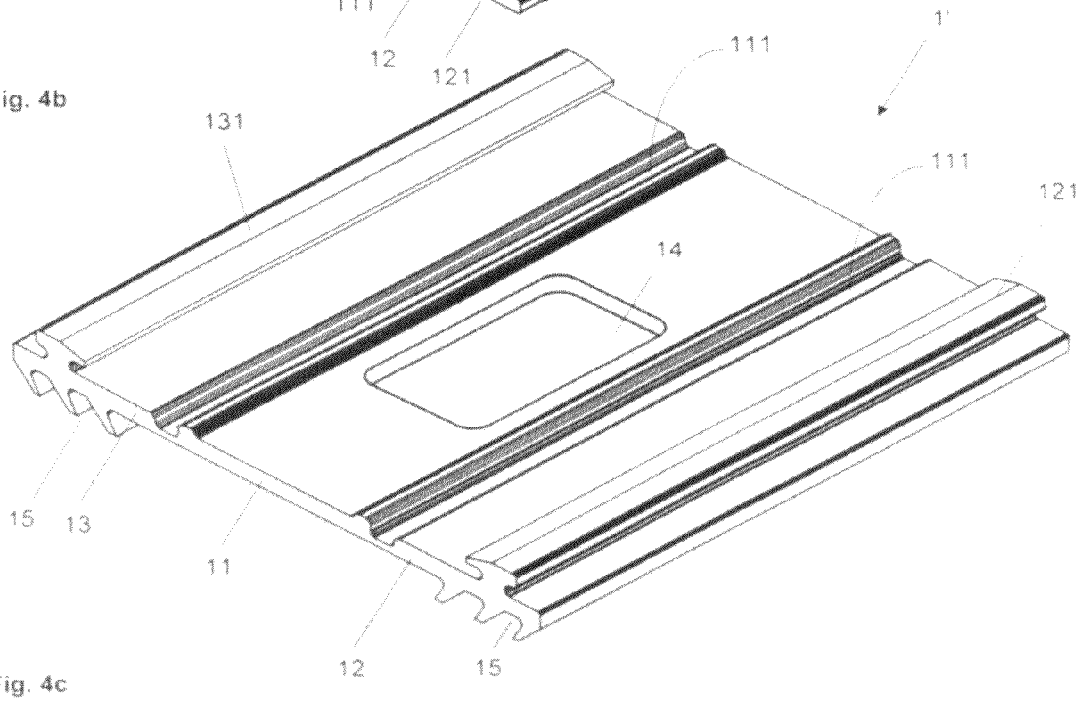
Figure 5A:
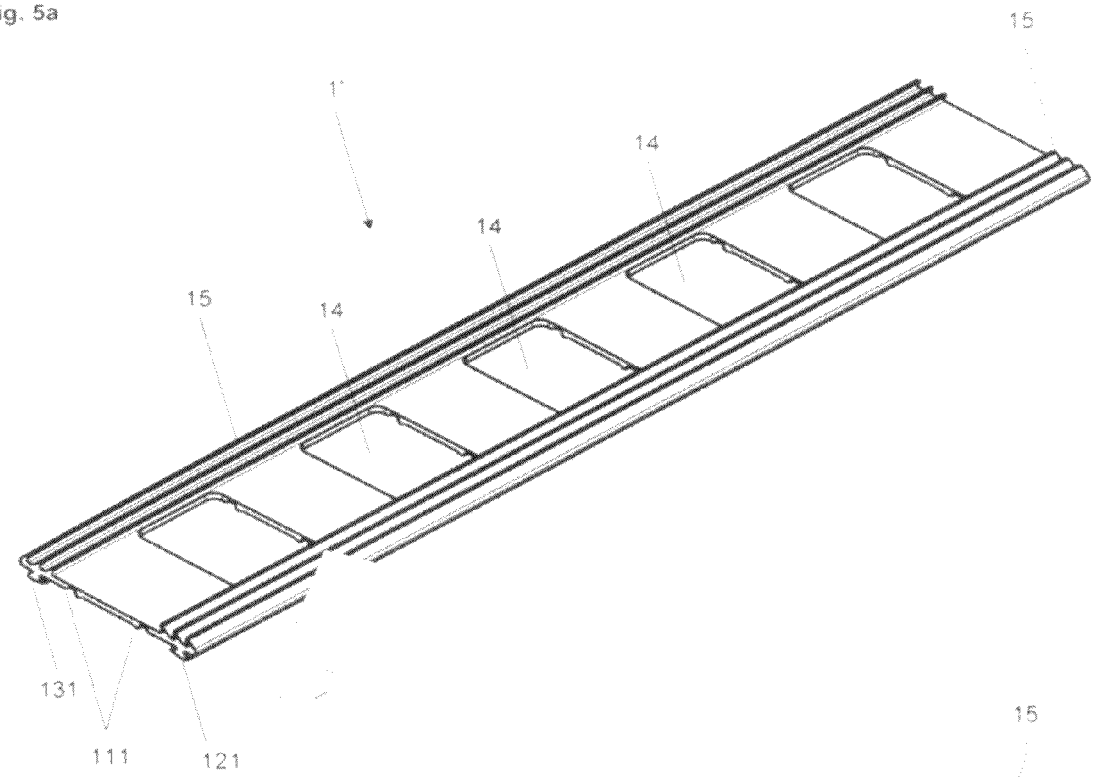
Figure 5B:
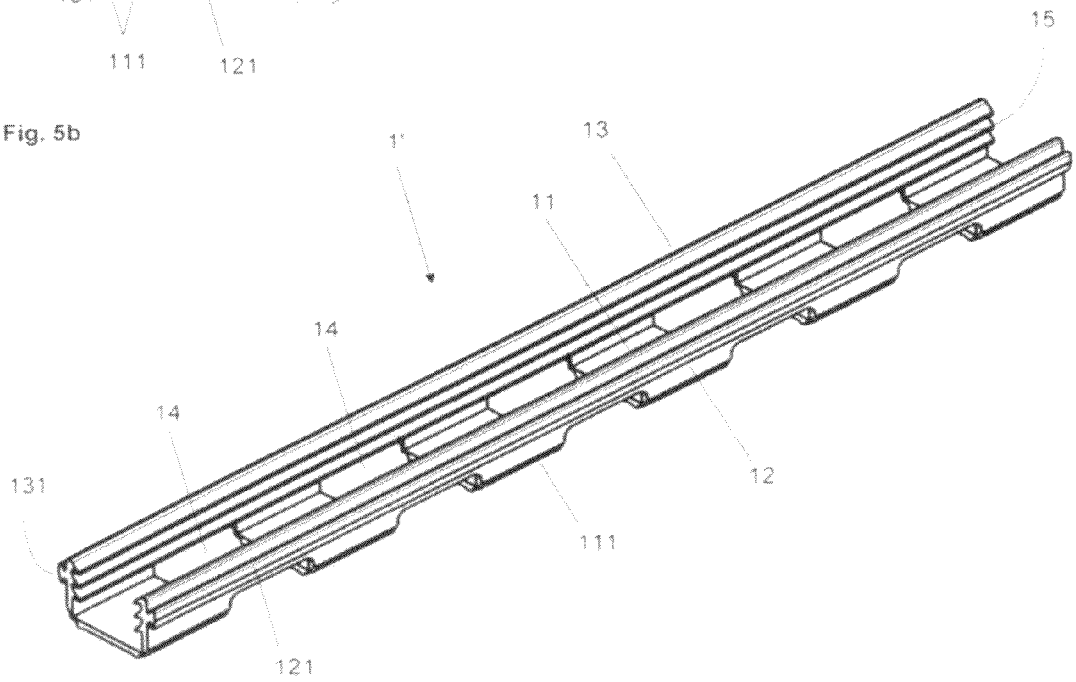
Figures 6, 6A:
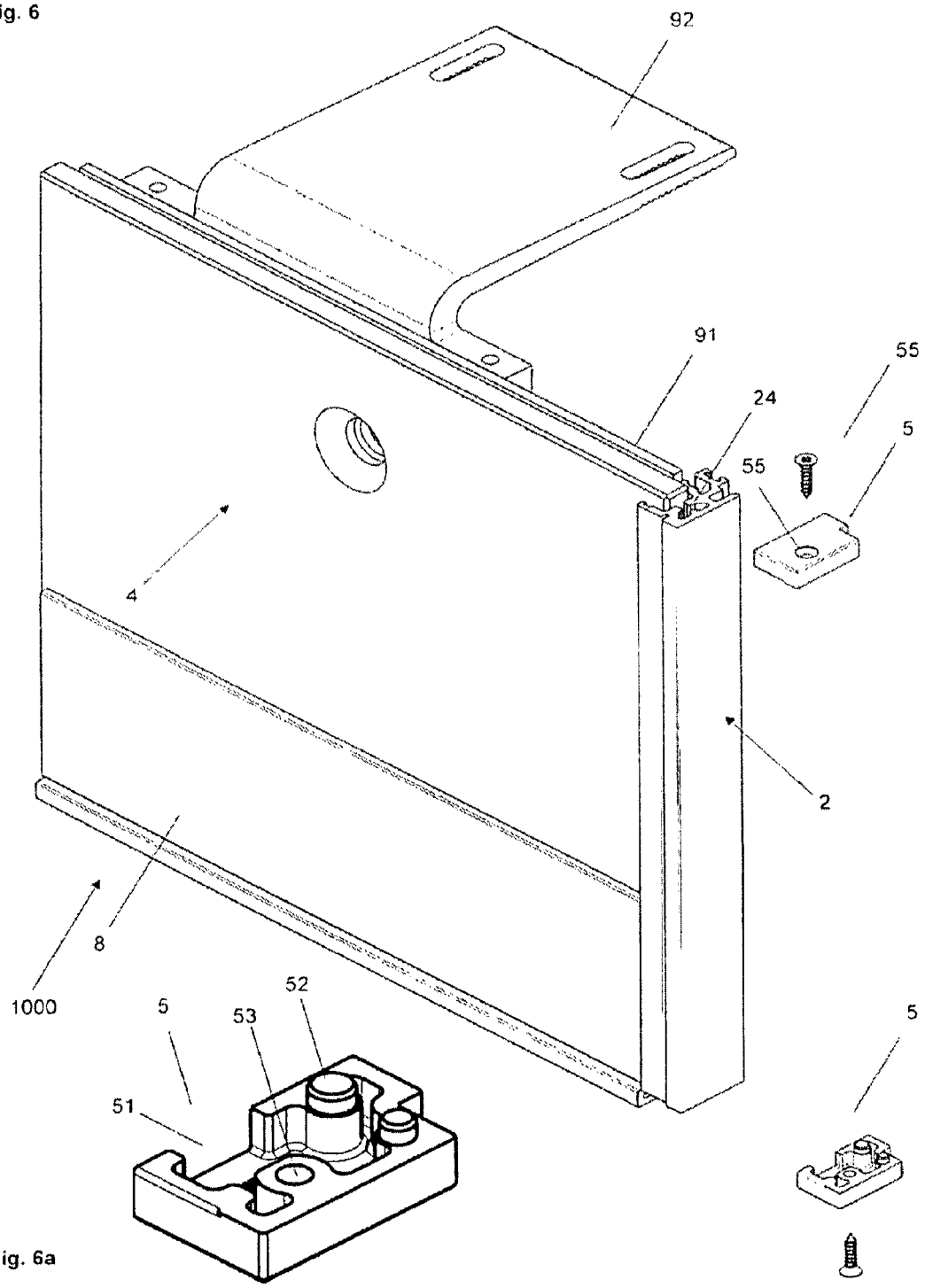
Figure 9:
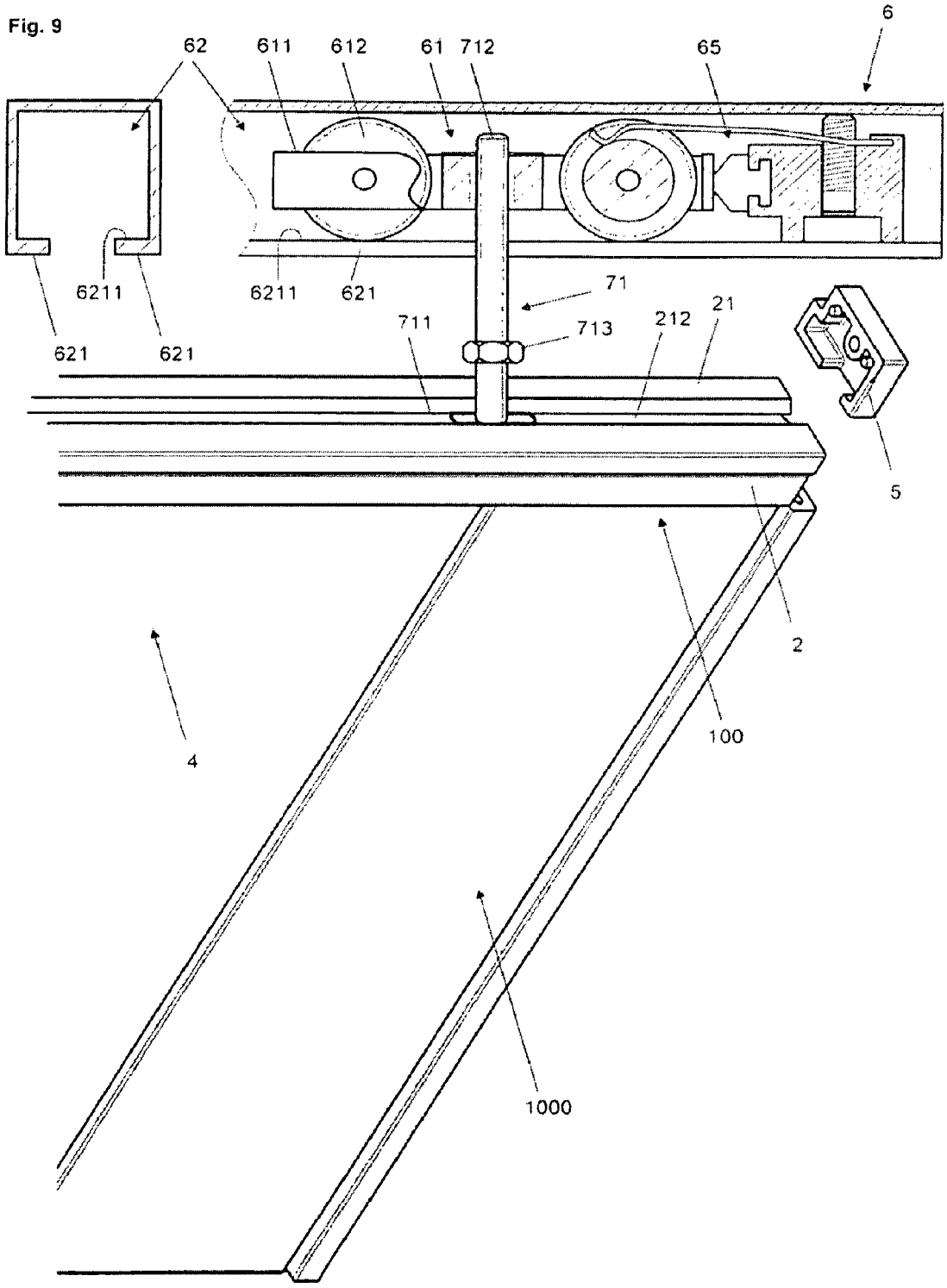

The invention is explained below by reference to drawings, in which:

FIG. 1 shows an inventive connecting device 1000, which comprises a profile strip 2 and a separation profile 1, which are connected by means of an adhesive 3 to a glass panel 4;

FIG. 1*a* an end element of the profile strip 2 of FIG. 1;

FIG. 1*b* an end element of the separation profile 1 of FIG. 1;

FIG. 2 the connecting device 100 connected to the glass panel 4 in a spatial representation;

FIG. 2*a* the connecting device 100 connected to the glass panel 4 and seen from the side;

FIGS. 3*a-c* the asymmetrically formed separation profile 1 of FIG. 1 in different views;

FIGS. 4*a-c* a symmetrically formed separation profile 1', which is provided on both side parts 12, 13 with fins 15;

FIG. 5*a* the separation profile 1' of FIG. 4*a* with profile parts 11, 12, 13 orientated in a plane;

FIG. 5*b* the separation profile 1' of FIG. 4*a* in the form of a U-shaped profile with side parts 12, 13 bent towards each other;

FIG. 6 a separation element 1000 provided with the inventive connecting device 100;

FIG. 6*a* a termination part 5 for the profile strip 2 of the connecting device 100 of FIG. 6;

FIG. 7 the connecting device 100 connected to the glass panel 4 with an additional profile 70 placed on the profile strip 2;

FIG. 8 a symmetrically formed separation profile 1", which is provided on both side parts 12, 13 with a respective sealing rib 16; and FIG. 9 a displaceably mounted separation element 1000 with a glass panel 4 (shown inclined), on the upper side of which an inventive connecting device 100 is mounted with a profile strip 2, which comprises a holding groove 212, within which a connecting element 71 connected to a carriage 61 is held.

FIG. 1 shows an inventive connecting device 100, which comprises a profile strip 2 and a separation profile 1, which are connected to the glass panel 4 by means of an adhesive 3.

The profile strip 2, of which the end element is shown enlarged in FIG. 1*a*, comprises a back element 21 and a first and a second side element 22, 23, which form an inner profile and an outer profile 200, which extend over the whole length of the profile strip 2. The inner profile comprises a mounting channel 24 serving to receive the glass panel 4, said mounting channel 24 being connected via a through slot 2111 to an anchor channel 211, which is incorporated into the back element 21. Each of the side elements 22, 23 comprises an anchor groove 221, 231 open towards the mounting channel 24, which anchor groove 221, 231 serves to hold the separation profile 1 introduced into the mounting channel 24.

The outer profile 200 of the profile strip 2 comprises on the side elements 22, 23 a respective mounting groove 222 and 232 respectively, which serve for the mounting of auxiliary profiles 70, such as holding grips, covers, bezels, further frames, mounting elements or coupling devices 71 (see FIGS. 7 and 8). The outer profile 200 can thus be formed as required in order to allow mounting one of said parts.

Furthermore the profile strip 2 comprises in this preferred embodiment a profile arm 25 with a sealing groove 251, which serves to receive a plastic seal or brush seal.

However, with regard to the connection of the profile strip 2 to the glass panel 4, the inner profile 20 of the profile strip 2 and the separation profile 1 are significant, the profile strip 2 being reliably separated from the glass panel by the separation profile 1.

The separation profile 1, which is shown in a first preferred embodiment in FIGS. 1, 1*b* and 3*a-c*, is for example in the form of a plastic strip, which can be cost-effectively produced using an extrusion process.

The separation profile 1, which is shown enlarged in FIG. 1*b*, comprises a middle part 11, which is connected by hinge zones, in this embodiment by film hinges with a fairly thin layer diameter, from a first and a second side part 12, 13. The side parts 12, 13 can be bent towards each other upwardly by 90°, as shown in FIG. 3*a*.

The differently formed side parts 12, 13 of the separation profile of FIG. 3*a* comprise on the side facing the profile strip 2 a respective anchor elements 121, 131, which engage in associated anchor grooves 221, 231 in the profile strip 2 and hold the separation profile 1 within the mounting channel 24 in a shape-locking manner. In addition the anchor elements 121, 131 prevent the adhesive 3 from escaping out of the mounting channel 24 along the side elements 22, 23.

The first side part 12 additionally comprises on the side facing the mounting channel 24 a sealing rib 16, which lies against the glass panel 4 after assembly and prevents the adhesive 3 from coming out of the mounting channel 24 on this side. The second side part 13 comprises on the side facing the mounting channel 24 three fins 15, which also prevent the adhesive 3 from coming out of the mounting channel 24. Said fins 15 simultaneously press the glass panel 4 towards the other side of the mounting channel 24 against the sealing rib 16, as shown in FIG. 2*a*.

In FIG. 1 it is further shown that the separation profile 1 is provided with regularly arranged, rectangular window openings 14, which run transversely through the middle part 11 of the separation profile 1 and project into the side parts 12, 13. The distances between the window openings 14 correspond approximately to the width of a window opening 14. The window openings 14 are of considerable importance for the inventive connecting device 100 as the bead of adhesive 3 applied can go through them and come into connection with the profile strip 2.

The inventive connecting device 100 can be assembled extremely easily in that preferably:

a) the separation profile is inserted into the mounting channel 24 of the profile strip 2, b) a bead of adhesive 3 is either applied within the mounting channel 24 to the separation profile 1 or previously to the narrow side of the glass panel 4, c) the glass panel 4 is introduced on the edge side into the mounting channel 24, and d) the profile strip 2 is pressed against the separation profile, as shown in FIG. 2.

By pressing the profile strip 2 against the glass panel 4 the adhesive 3 advances on the one hand along the edge of the glass panel 4 as far as the fins 15 and the sealing rib 16. On the other hand the adhesive 3 goes through the window openings into direct contact with the profile strip 2 and is partially displaced through the through slot 2111 into the anchor channel 211, as shown in FIG. 2*a*. This results in two advantages. Firstly, excess adhesive 3 escapes from the mounting channel 24 only into the anchor channel 211 and not forward along the glass panel 4. An excessive pressure within the mounting channel 24, which could impair the sealing rib 16 or the fins 15, is avoided. Secondly, the adhesive 3 is held in a shape-locking way in the anchor channel 211 after hardening, so that the adhesive 3 can no longer become detached from the profile strip 2 upon loading.

As shown in FIG. 2*a*, second anchor grooves 223, 233 can be provided in the two side elements 22, 23. The adhesive 3, which has passed through the window openings 14, can also penetrate into the second anchor grooves 223, 233 and form a shape-locking connection.

FIG. 3*a* shows a cross-section through the strip-form separation profile 1, which has an asymmetrical form in the first embodiment.

FIG. 3*b* shows the side of the separation profile 1 of FIG. 3*a* that faces the glass panel 4 after installation.

FIG. 3*c* shows the side of the separation profile 1 of FIG. 3*a* that faces the profile strip 2 after installation.

The window opening 14 is shown relatively small and preferably extends in practice beyond the hinge zones 11.

FIG. 4*a* shows a cross-section of a further strip-form separation profile 1', which has a symmetrical form/identical side parts 12, 13. On the first side part 12, instead of the sealing rib 16, three fins 15 are provided, which likewise push towards the glass panel 4 after installation. In this embodiment of the separation profile 1' therefore three fins 15 are provided on each of the two side parts 12, 13. The glass panel 4 is automatically centred within the mounting channel 24 by the fins 15 provided on each side.

FIG. 4*b* shows the side of the separation profile 1' of FIG. 4*a* that faces the glass panel 4 after installation.

FIG. 4*c* shows the side of the separation profile 1' of FIG. 4*a* that faces the profile strip 2 after installation.

FIG. 5 shows the separation profile 1' of FIG. 4*a* with profile parts 11, 12, 13 orientated in a plane. In this form the separation profile 1' can be packed and supplied in a space saving way. FIG. 5*b* shows the separation profile 1' of FIG. 4*a* with side parts 12, 13 bent towards each other in the form of a U-shaped profile, in which the separation profile 1' is inserted into the mounting channel 24.

FIG. 6 shows a separation element 1000 provided with the inventive connecting device 100. Said separation element 1000 can be held on the upper side by means of a mounting strip 91 and a mounting profile 92. For example the mounting profile 92 is supported on a carriage guided in a rail in such a way that the separation element 1000 can be displaced along the rail. The inventive device 100 with the profile strip 2 is mounted in this embodiment of the separation element 1000 on the sides of the glass panel 4, whereby the glass panel 4 is laterally framed and protected against mechanical impacts. Termination parts 5 are placed at both ends of the mounted profile strip 2 and fixed by means of mounting screws 55. The mounting screws 55 are guided through a screw channel 53 in the termination part 5 and are turned between three thread ribs 2112, which extend parallel to each other at the same distance in the anchor channel 211 and allow a screw to cut a thread into the material of the thread ribs 2112 (see FIG. 1*a*).

FIG. 6*a* shows one of the termination parts 5 of FIG. 6. It can be seen that said termination part 5 comprises an opening 51 for receiving a corner of the glass panel 4 and also comprises mounting cams, which can engage in the profile strip 2 and hold the termination part 5 in the desired position. It is further shown that the termination part 5 is adapted to a cover profile 8, which is provided on the lower side of the glass panel 4.

FIG. 7 shows the connecting device 100 connected to the glass panel 4, with an auxiliary profile 70 placed on the profile strip 2. The inner profile of this auxiliary profile 70 is adapted to the outer profile 200 of the profile strip 2. As shown, the inner profile of the auxiliary profile 70 engages in mounting grooves 222, 223, which are provided on the side elements 22, 23 of the profile strip 2. The auxiliary profile 70 serves in this embodiment as a hand grip for gripping and displacing the separation element 1000.

FIG. 8 shows a symmetrically formed separation profile 1", which is provided on both side parts 12, 13 with a respective sealing rib 16. Separation profiles 1" of this type can be advantageously used if the panels 4 always have the same thickness.

FIG. 9 shows a displaceably mounted separation element 1000 with a glass panel 4, on the upper side of which an inventive connecting device 100 with a profile strip 2 is mounted. The back element 211 of the profile strip 21 comprises a holding groove 212, within which the head element 711 of a coupling device is 71 is held. Said coupling device 71 is connected to a guide device 6. Said guide device 6 includes a carriage 61 guided in a running rail 62, which carriage 61 comprises a carriage body 611 and running rollers 612 fixed thereto. The running rollers 612 are guided on the surfaces 6211 of foot elements 612 of the running rail 62. A buffer device 65 forming an end stop is provided within the running rail 62.

The coupling device 71 can be a connecting screw, of which the screw head can be introduced into the holding groove 212, which is T-profile-shaped for example. The threaded shank of said connecting screw can be turned into the body 611 of the carriage 61. The connecting screw is fixed after adjustment for example by means of at least one nut 713. Correspondingly designed connecting screws are known for example from [3], U.S. Pat. No. 6,418,588.

In a further preferred embodiment the body 611 of the carriage can also comprise a profile element, which can engage directly in the holding groove 212.

Literature:

[1] DE 35 09 187 A1
[2] U.S. 60/520,867
[3] U.S. Pat. No. 6,418,588

List of Reference Numerals:

1 Separation profile in a first embodiment
1' Separation profile in a second embodiment
100 Connecting device
1000 Separation element with glass panel 4
11 Middle part of the separation profile 1
111 Film hinge
12 First side part of the separation profile 1
121 Anchor element on the second profile part 12
13 Second side part of the separation profile 1
131 Anchor element on the third profile part 13
14 Window openings
15 Fins
16 Sealing rib
2 Profile strip
20 Inner profile of the profile strip 2
200 Outer profile of the profile strip 2
21 Back element of the profile strip 2
211 Anchor channel in the first profile element 21
2111 Through slot
2112 Thread ribs
212 Holding groove, e.g. for the connecting element 63
22 First side element of the profile strip 2
221 Anchor groove in the first side element 22
222 Mounting groove in the first side element 22
223 Second anchor groove in the first side element 22
23 Second side element of the profile strip 2
231 Anchor groove in the second side element 23
232 Mounting groove in the second side element 23
233 Second anchor groove in the second side element 23
24 Mounting channel
25 Profile arm
251 Sealing groove on the profile arm 25
3 Adhesive, silicone adhesive
4 Panel, particularly glass panel
5 Termination part for the profile strip 2
51 Receiving opening in the termination part 5
52 Mounting cams on the termination part 5
53 Screw channel on the termination part 5
55 Mounting screw
6 Guide device for the displaceable separation element
61 Carriage
611 Carriage body

612 Running wheels
62 Rail, running or guide rail e.g. L-shaped or U-shaped profile
621 Foot elements of the rail 62
65 Buffer within the rail 62
70 Auxiliary profile
71 Coupling device
711 Head element of the coupling device 71
712 Connecting element of the coupling device 71
713 Nut
8 Cover profile
91 Mounting strip
92 Mounting profile

The invention claimed is:

1. A connecting device for a separation element with a panel having at least one edge, for use with an adhesive, the connecting device comprising:
at least one profile strip including
a back element,
a first side element and a second side element that together define a mounting channel, and
an anchor channel defined by the profile strip, wherein the anchor channel is connected to the mounting channel by a through slot, wherein the mounting channel is configured such that the edge of the panel is held within the mounting channel by means of the adhesive; and
a separation profile including a middle part, a first side part, and a second side part, and defining at least one window opening that functions to allow the adhesive to penetrate into the anchor channel,
wherein the separation profile is disposed such that the at least one profile strip is separated from the panel.

2. The connecting device according to claim 1, wherein at least one of the first side element and second side element define at least one anchor groove open towards the mounting channel-, wherein the at least one anchor groove may receive an anchor element provided on the separation profile or the adhesive.

3. The connecting device according to claim 1, wherein the anchor channel tapers towards the through slot.

4. The connecting device according to claim 1, wherein
a) the profile strip further includes an inner profile adapted to the separation profile; and/or
b) the profile strip further includes an outer profile-, which is connectable to an auxiliary profile and/or to a coupling device, that is/are connectable to a carriage guided in a rail.

5. The connecting device according to claim 1, wherein at least one mounting groove is provided on at least one side of at least one of the first side element and the second side element facing away from the panel, and/or wherein at least one holding element is provided on the side of the back element facing away from the panel.

6. The connecting device according to claim 1, wherein at least one termination part includes an opening for receiving a corner of the panel, and is mounted at at least one send of the profile strip, and is adapted to be simultaneously mounted to a further profile strip and/or to a cover profile.

7. The connecting device according to claim 6, wherein at least one thread rib is provided in the anchor channel-, and serves to receive a mounting screw that can be guided through a screw channel provided in the at least one termination part.

8. The connecting device according to claim 1, wherein
a) the separation profile is produced from non-elastic plastic in a form adapted to the mounting channel, or
b) the separation profile is produced from elastic plastic, wherein the middle part of the separation profile is connected by means of flexible hinge zones to the first side part and the second side part.

9. The connecting device according to claim 1, further comprising at least one fin and/or at least one sealing rib on the first side part and/or the second side part of the separation profile, wherein the least one fin and/or at least one sealing rib is arranged facing the panel.

10. The connecting device according to claim 9, wherein the at least one fin or the at least one sealing rib is flush with the associated end of the side element of the profile strip.

11. The connecting device according to claim 1, wherein the at least one window opening overlaps the middle part and/or partially overlaps at least one of the first side part and second side part and/or are equally spaced.

12. A door system comprising:
a panel; and
a connecting device including
at least one profile strip including
a back element,
a first side element and a second side element that together define a mounting channel, and
an anchor channel defined by the profile strip, wherein the anchor channel is connected to the mounting channel by a through slot, wherein the mounting channel is configured such that the edge of the panel is held within the mounting channel by means of the adhesive; and
a separation profile including a middle part, a first side part, and a second side part, and defining at least one window opening that functions to allow the adhesive to penetrate into the anchor channel;
wherein the separation profile is disposed such that the at least one profile strip is separated from the panel.

13. The door system according to claim 12, wherein the connecting device defines a frame element or termination element on at least one side of the panel, and the frame element or termination element is connectable to an auxiliary profile.

14. The door system according to claim 12, wherein the at least one profile strip is provided on an upper side and/or a lower side of the panel, and the at least one profile strip is connected by means of at least one coupling device to at least one guide device.

15. The door system according to claim 12, wherein the at least one profile strip is connected by at least one connecting screw and/or by at least one profile part to a carriage.

16. The door system according to claim 12, wherein the panel is made of glass.

17. The connecting device according to claim 1, further comprising the adhesive.

18. The connecting device according to claim 1, wherein the at least one profile strip further includes a first ledge connected to the first side element and a second ledge connected to the second side element, wherein the first ledge extends toward the second side element and the second ledge extends toward the first side element, wherein the first ledge and second ledge together define the through slot.

* * * * *